US008686304B2

(12) United States Patent
Maloney

(10) Patent No.: US 8,686,304 B2
(45) Date of Patent: Apr. 1, 2014

(54) ELECTRICAL SWITCHING APPARATUS INCLUDING TWO POLES AND A SINGLE OPERATING HANDLE

(75) Inventor: James G. Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 231 days.

(21) Appl. No.: 13/313,104

(22) Filed: Dec. 7, 2011

(65) Prior Publication Data

US 2013/0146428 A1 Jun. 13, 2013

(51) Int. Cl.
*H01H 9/26* (2006.01)

(52) U.S. Cl.
USPC ..... 200/50.32

(58) Field of Classification Search
USPC ..... 200/5 R, 5 B, 17 R, 18, 50.32, 330, 332
See application file for complete search history.

(56) References Cited

U.S. PATENT DOCUMENTS

| | | | | |
|---|---|---|---|---|
| 2,913,542 | A * | 11/1959 | Myers | 200/5 R |
| 3,959,752 | A | 5/1976 | Strobel et al. | |
| 4,077,024 | A | 2/1978 | Lisnay | |
| 4,906,958 | A | 3/1990 | Adamson | |
| 5,043,687 | A | 8/1991 | Gibson | |
| 5,453,723 | A | 9/1995 | Fello et al. | |
| 5,483,211 | A | 1/1996 | Carrodus et al. | |
| 6,239,676 | B1 | 5/2001 | Maloney et al. | |
| 6,369,340 | B1 * | 4/2002 | Castonguay et al. | 200/17 R |
| 6,614,334 | B1 | 9/2003 | Gibson et al. | |
| 6,700,467 | B2 * | 3/2004 | Castonguay et al. | 335/174 |
| 6,737,594 | B2 * | 5/2004 | Helms et al. | 200/43.19 |
| 2011/0132733 | A1 * | 6/2011 | An | 200/17 R |
| 2012/0145520 | A1 * | 6/2012 | Grumel et al. | 200/17 R |

* cited by examiner

*Primary Examiner* — Felix O Figueroa
(74) *Attorney, Agent, or Firm* — Eckert Seamans Cherin & Mellott, LLC; Kirk D. Houser

(57) ABSTRACT

An electrical switching apparatus includes an enclosure having an opening, a single operating handle disposed through the enclosure opening, a first pole disposed in the enclosure and including first separable contacts, a first operating mechanism to open and close the first contacts, and a first operating member cooperating with the first operating mechanism to open and close the first contacts. A second pole is disposed in the enclosure and includes second separable contacts, a second operating mechanism to open and close the second contacts, and a second operating member cooperating with the second operating mechanism to open and close the second contacts. The single operating handle, centered between parallel poles, includes a first projection within the enclosure cooperating with the first operating member to open and close the first contacts, and a second projection within the enclosure cooperating with the second operating member to open and close the second contacts.

12 Claims, 6 Drawing Sheets

ELECTRICAL SWITCHING APPARATUS INCLUDING TWO POLES AND A SINGLE OPERATING HANDLE

BACKGROUND

1. Field

The disclosed concept pertains generally to electrical switching apparatus and, more particularly, to such electrical switching apparatus including two poles and a single operating handle.

2. Background Information

Circuit breakers are generally old and well known in the art. Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Known conventional two-pole circuit breakers with dual parallel poles are believed to employ either: (a) two operating handles with a handle tie; or (b) a single operating handle over one of the poles with a shaft to actuate the other pole, but with the single operating handle not being centered and it being apparent that it is a dual pole device.

U.S. Pat. No. 6,614,334 discloses a single-pole circuit breaker including a housing, first and second circuit breaker mechanisms, a single operating handle having on and off positions, and first and second links from the operating handle to the respective first and second operating mechanisms. The first and second operating mechanisms are physically disposed in series along a longitudinal axis, which causes the circuit breaker to be relatively elongated. Two sets of separable contacts are controlled by the first and second operating mechanisms and are electrically connected in series as part of a single pole to improve the operating voltage and/or interrupting capacity of the single-pole circuit breaker. A three-pole circuit breaker can be formed by stacking three such single-pole circuit breakers in parallel, with a trip actuator member being disposed between each set of two parallel single-pole circuit breakers.

There is room for improvement in electrical switching apparatus, such as two-pole circuit breakers.

SUMMARY

These needs and others are met by embodiments of the disclosed concept, which includes a single operating handle centered between first and second poles.

In accordance with aspects of the disclosed concept, an electrical switching apparatus comprises: an enclosure having an opening; a single operating handle disposed through the opening of the enclosure; a first pole disposed in the enclosure, the first pole comprising: first separable contacts, a first operating mechanism structured to open and close the first separable contacts, and a first operating member cooperating with the first operating mechanism to open and close the first separable contacts; and a second pole disposed in the enclosure parallel to the first pole, the second pole comprising: second separable contacts, a second operating mechanism structured to open and close the second separable contacts, and a second operating member cooperating with the second operating mechanism to open and close the second separable contacts, wherein the single operating handle comprises a first projection within the enclosure cooperating with the first operating member to open and close the first separable contacts, and a second projection within the enclosure cooperating with the second operating member to open and close the second parallel separable contacts, and wherein the single operating handle is centered between the first and second parallel poles.

The first projection may comprise a first tapered channel therein; the first operating member may comprise a first tapered member engaging the first projection at the first tapered channel; the second projection may comprise a second tapered channel therein; and the second operating member may comprise a second tapered member engaging the second projection at the second tapered channel.

The enclosure may comprise a plurality of sides; one of the sides may comprise a side portion and a raised portion extending beyond the side portion; and the single operating handle may further comprise a handle portion extending external to the enclosure, an arcuate portion coupled to the handle portion within the enclosure and being partially visible through the opening of the enclosure, and an internal portion entirely within the enclosure and being coupled to the first and second projections within the enclosure.

The raised portion of the one of the sides may clear the arcuate portion of the single operating handle; and only the single operating handle may be visible through the opening.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a two-pole circuit breaker, although the disclosed concept is applicable to a wide range of two-pole electrical switching apparatus.

Figure 1:
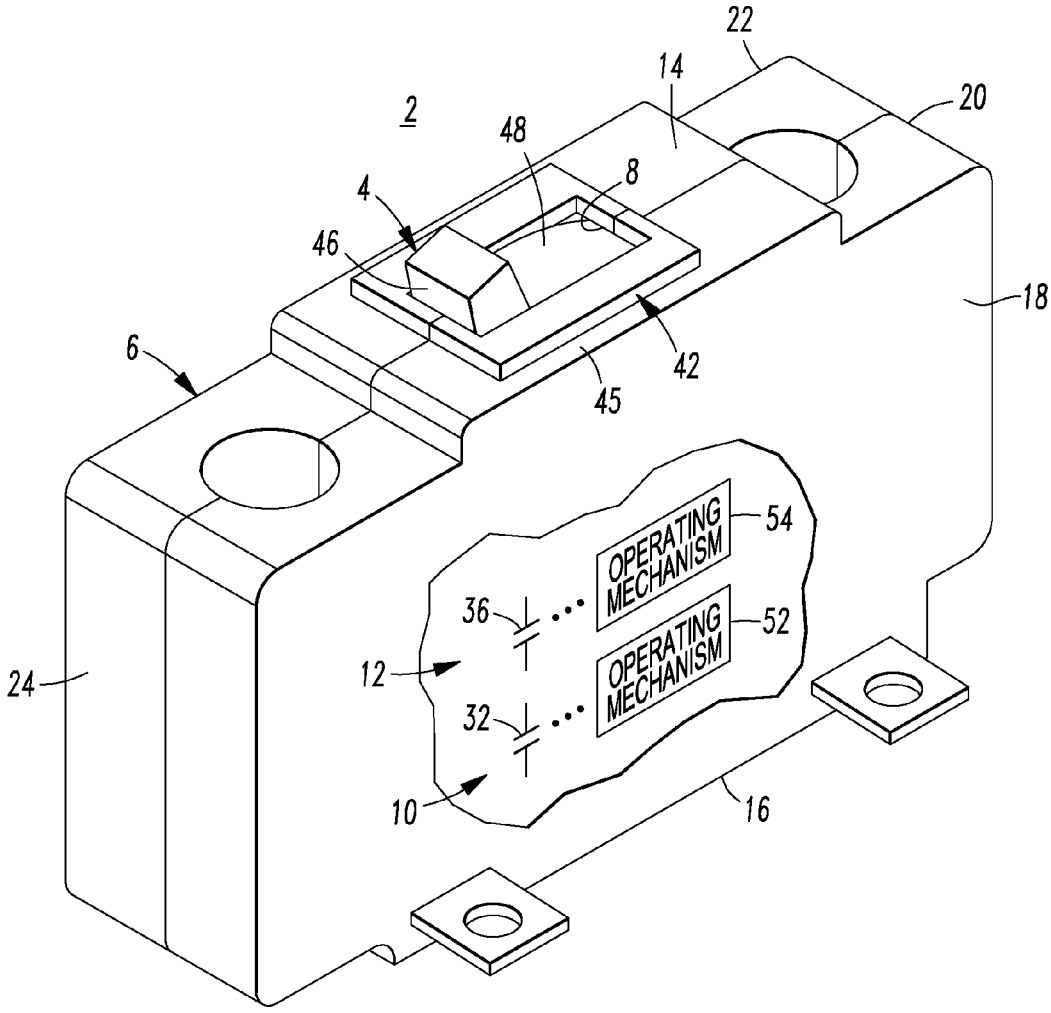
FIG. 1 is an isometric view of a two-pole circuit breaker including a single external operating handle in accordance with embodiments of the disclosed concept.

Referring to FIG. 1, an electrical switching apparatus, such as a two-pole circuit interrupter, a main (two-pole) circuit breaker, or a two-pole circuit breaker 2 is shown. The example two-pole circuit breaker 2 includes a single external operating handle 4. The disclosed concept employs a centered main style of operating handle 4, while hiding the fact that it is a dual mechanism device and providing a more robust, main circuit breaker appearance. The example circuit breaker 2 includes an enclosure 6 having an opening 8. The example single external operating handle 4 is disposed through the enclosure opening 8. First and second poles 10,12 are disposed in the enclosure 6. The first pole 10 is shown in FIGS. 4-7. The second pole 12 is essentially identical to the first pole 10 and is parallel to the first pole 10, but is hidden in FIGS. 4-7. The single external operating handle 4 is centered between the first and second poles 10,12.

The enclosure 6 includes six sides 14,16,18,20,22,24. The example opening 8 is centrally located on the side 14. The first pole 10 is proximate side 18 and the second pole 12 is proximate opposite side 22.

Figure 2:
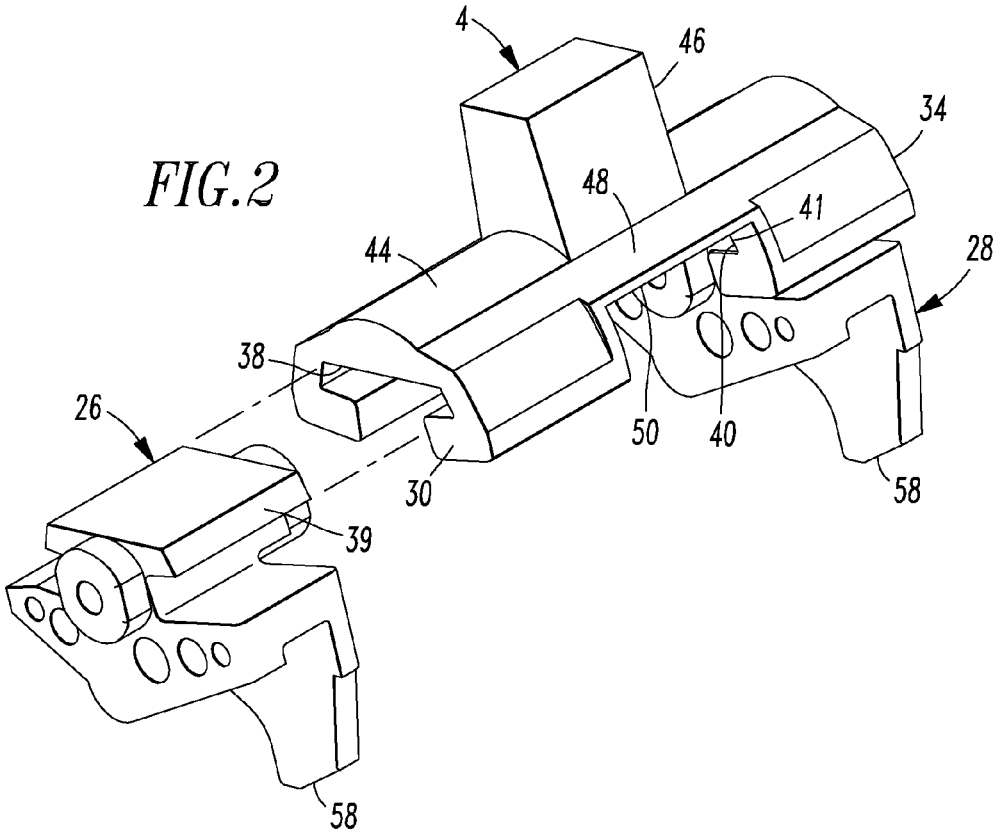
FIG. 2 is an exploded isometric view of the single external operating handle of FIG. 1 and two internal operating members.
Figure 3:
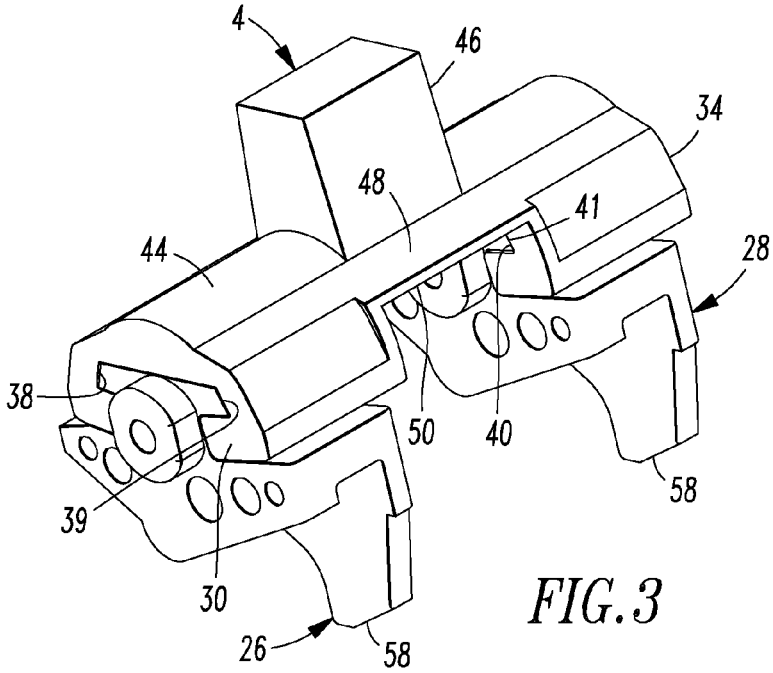
FIG. 3 is an assembled isometric view of the single external operating handle of FIG. 1 and the two internal operating members of FIG. 2.

Referring to FIGS. 2 and 3, the single external operating handle 4 of FIG. 1 is shown with two internal operating members 26,28. The operating handle 4 includes a first projection 30 within the enclosure 6 cooperating with the first internal operating member 26 to open and close first separable contacts 32 (FIGS. 1 and 4-7), and a second projection 34 within the enclosure 6 cooperating with the second operating member 28 to open and close second separable contacts 36 (FIG. 1).

In this example, the first projection 30 includes a first tapered channel 38 therein, and the first internal operating member 26 includes a first tapered member 39 engaging (FIG. 3) the first projection 30 at the first tapered channel 38. Also, the second projection 34 includes a second tapered channel 40 therein, and the second internal operating member 28 includes a second tapered member 41 engaging (FIGS. 2 and 3) the second projection 34 at the second tapered channel 40. The tapers of the channels 38,40 and the members 39,41 are best shown in FIG. 3. The two individual internal operating members 26,28 are employed, one for each of the two parallel poles 10,12, respectively, with the tapered members 39,41 on the top (with respect to FIGS. 2 and 3), in order that they can be slid into the respective channels 38,40.

Alternatively, the first projection 30 can be a first tapered member (not shown), the second projection 34 can be a second tapered member (not shown), the first internal operating member 26 can include a first tapered channel (not shown) for mating with the first tapered member (not shown), and the second internal operating member 28 can include a second tapered channel (not shown) for mating with the second tapered member (not shown).

As shown in FIG. 1, if needed, a raised portion 42 on the top (with respect to FIG. 1) side 14 of the circuit breaker 2 can be employed to clear a radius portion 44 (FIGS. 2 and 3) of the main centered single external operating handle 4. When looking into the handle opening 8, only the single external operating handle 4 can be seen.

Referring to FIGS. 1-3, the top (with respect to FIG. 1) side 14 of the circuit breaker 2 includes a side portion 45 and the raised portion 42 extending beyond the side portion 45. The single external operating handle 4 includes a handle portion 46 extending external to the enclosure 6, an arcuate portion 48 coupled to the handle portion 46 within the enclosure 6 and being partially visible through the enclosure opening 8, and an internal portion 50 entirely within the enclosure 6 and being coupled to the first and second projections 30,34 within the enclosure 6.

Figure 4:
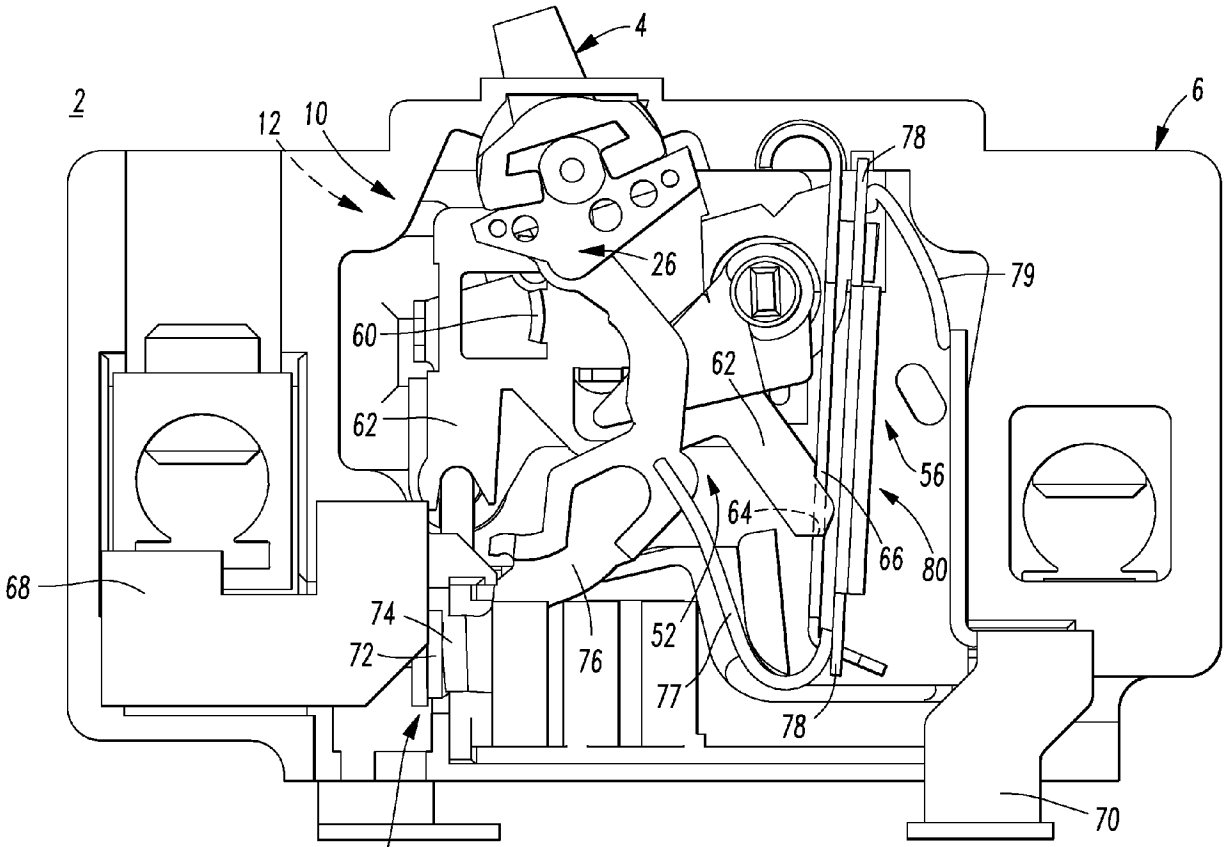
FIGS. 4-7 are vertical elevation cross sectional views of the two-pole circuit breaker of FIG. 1 in on, tripped, off and reset positions, respectively.
Figure 5:
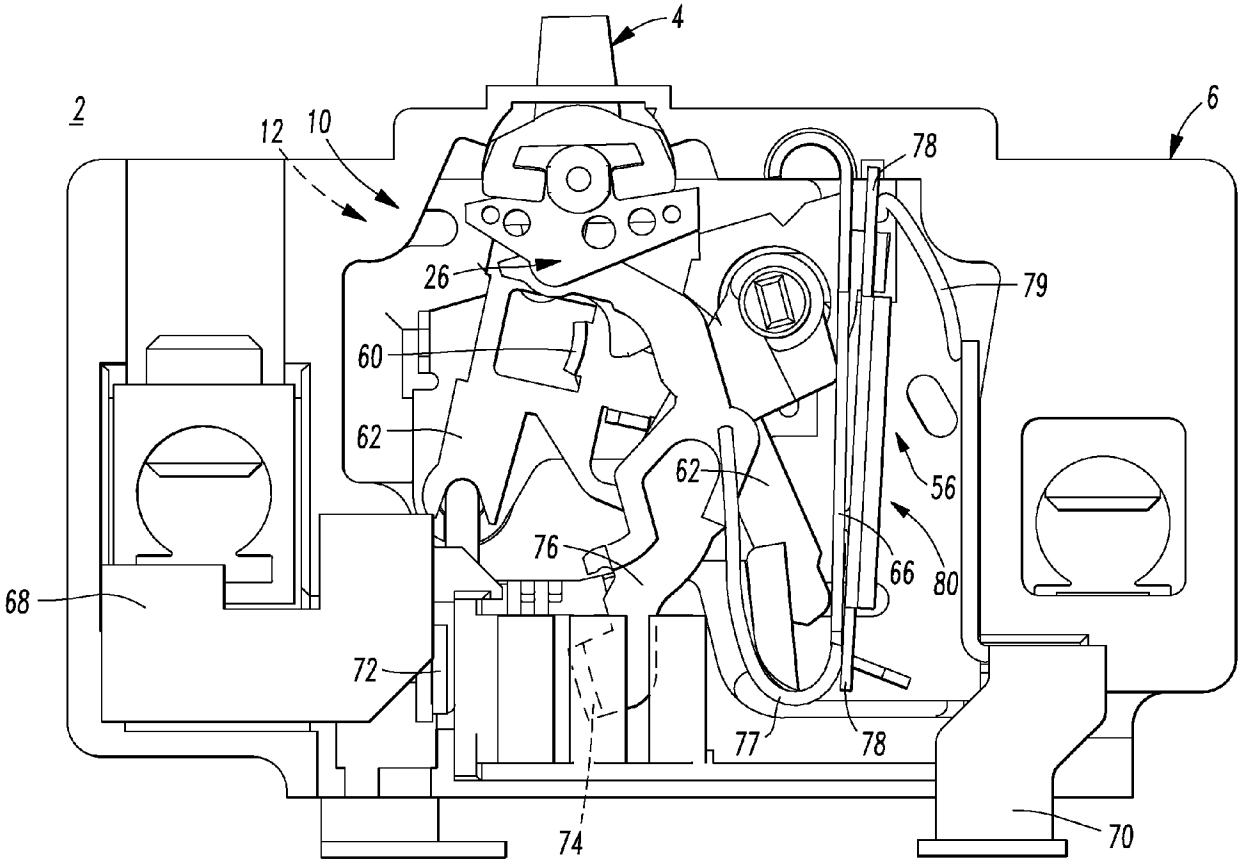
Figure 6:
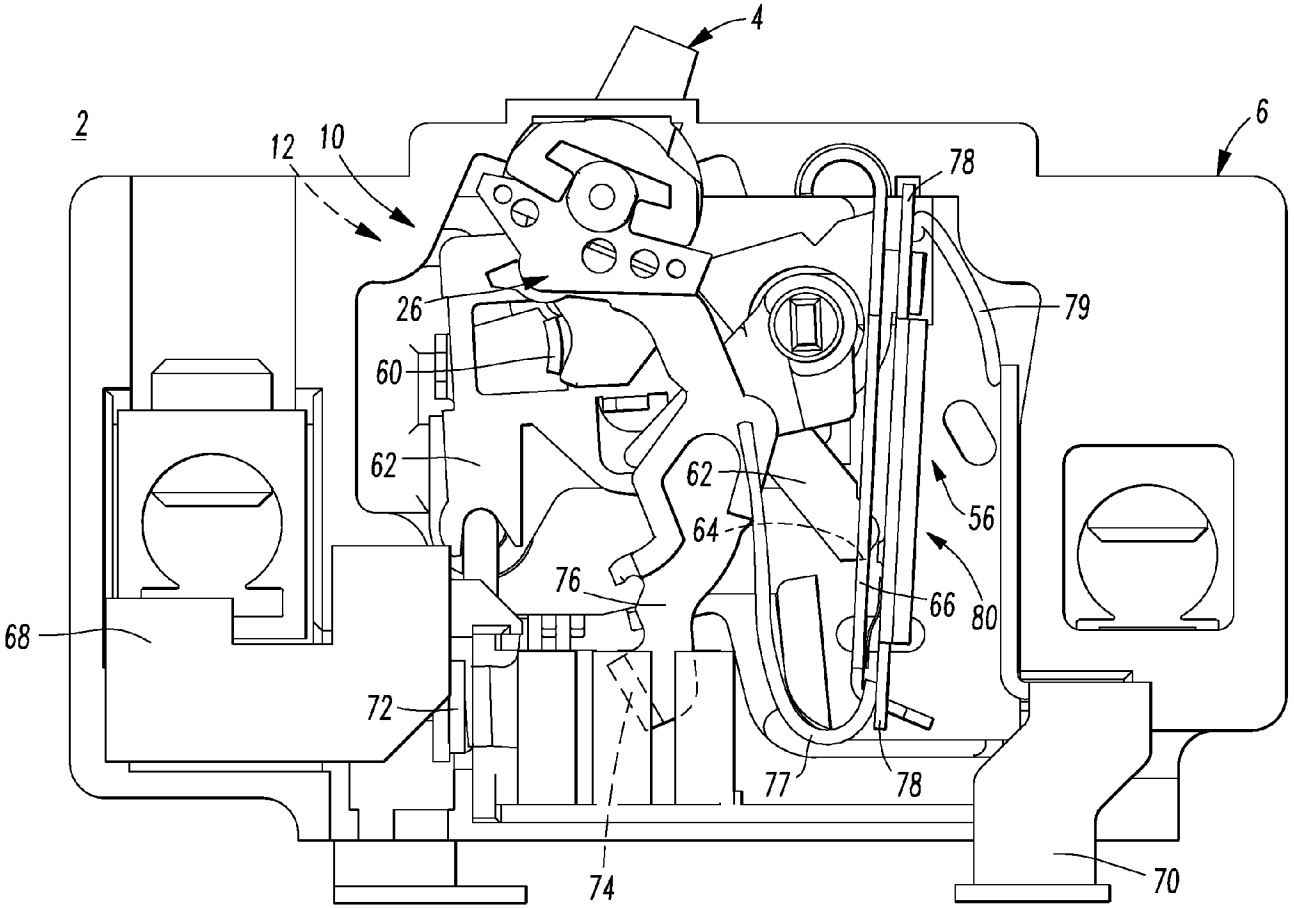
Figure 7:
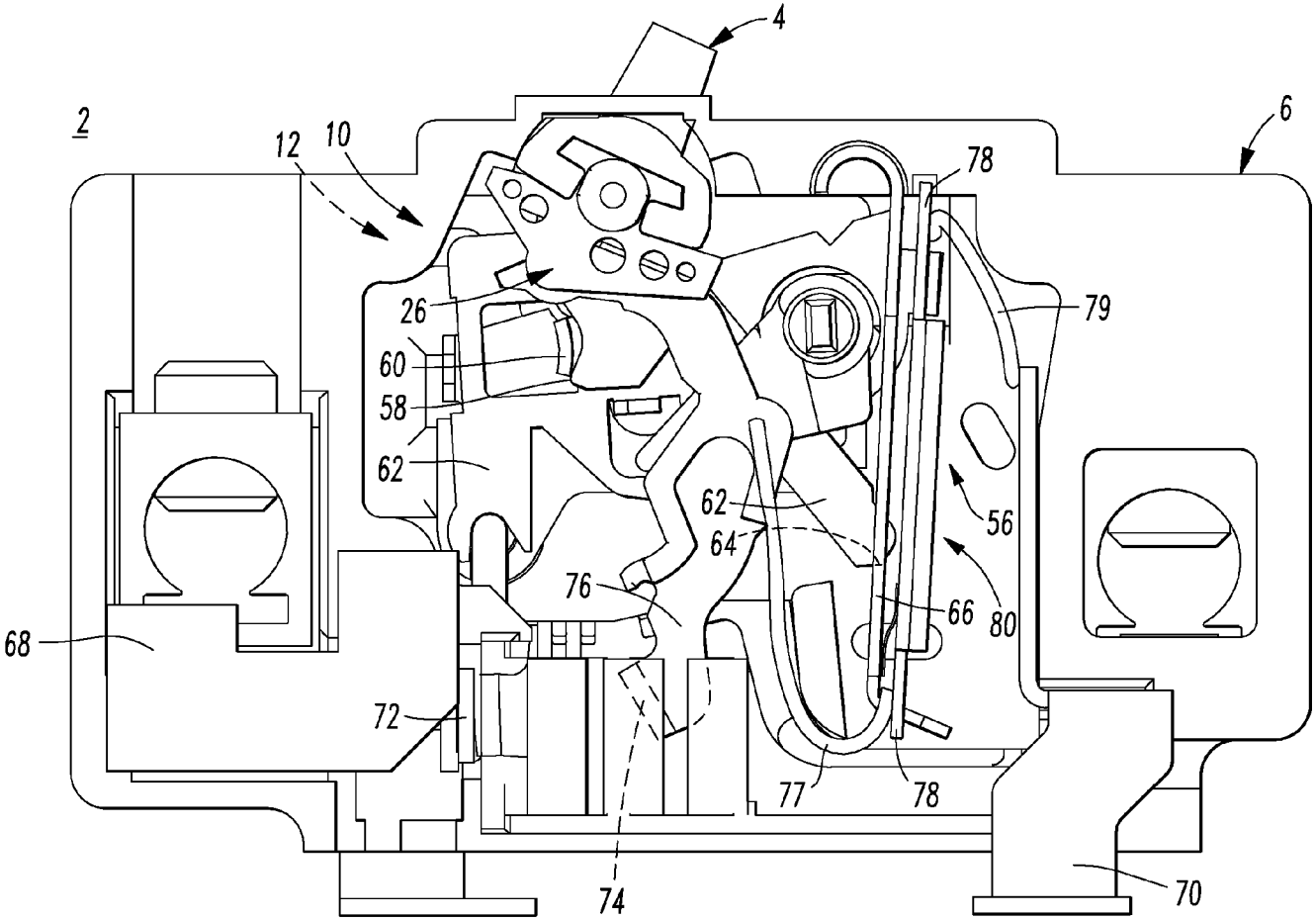

FIGS. 4-7 show the two-pole circuit breaker 2 of FIG. 1 in on, tripped, off and reset positions, respectively. For example, as shown in FIG. 4, the single external operating handle 4 has an on position with respect to the enclosure 6. Each of the first and second internal operating members 26 (shown in FIGS. 2-7) and 28 (shown in FIGS. 2 and 3) has an on position corresponding the on position of the single external operating handle 4. FIGS. 5-7 respectively show the tripped, off and reset positions of the single external operating handle 4 and the corresponding respective tripped, off and reset positions of the first and second internal operating members 26,28.

The first pole 10 includes the first separable contacts 32, a first operating mechanism 52 structured to open and close the first separable contacts 32, and the first internal operating member 26 cooperating with the first operating mechanism 52 to open and close the first separable contacts 32.

The second pole 12 (FIG. 1) includes the second separable contacts 36, which are electrically independent of the first separable contacts 32, a second operating mechanism 54 structured to open and close the second separable contacts 36, and the second internal operating member 28 (FIGS. 2 and 3) cooperating with the second operating mechanism 54 to open and close the second separable contacts 36.

As shown with the first pole 10 (FIGS. 4-7), each of the first and second poles 10,12 further includes a trip mechanism 56 cooperating with a corresponding one of the first and second operating mechanisms 52,54 to trip open the respective first and second separable contacts 32,36.

The off and reset positions of FIGS. 6 and 7 almost look exactly the same except in the reset position, the single external operating handle 4 is a little more rotated (clockwise with respect to FIG. 7) which makes the bottom 58 (FIGS. 2, 3 and 7) of the internal operating member 26 hit a projection 60 on a cradle 62 to make the cradle 62 rotate a little, lifting it off a latch surface 64 on armature 66.

As shown in FIGS. 4-7, the example circuit breaker 2 includes conventional internal and external structures for each of the two poles 10,12. As shown with the first pole 10, these structures include a line terminal 68, a load terminal 70, a fixed contact 72, a movable contact 74, a movable arm 76, a bimetal 78, a magnetic trip circuit/armature 80 including the armature 66 and its latch surface 64, and the cradle 62. The current path through the circuit breaker 2 passes from the line terminal 68 to the fixed contact 72, to the movable contact 74 when the first separable contacts 32 are closed, to the movable arm 76, through first flexible shunt 77 to the bimetal 78, and through the bimetal 78 and second flexible shunt 79 to the load terminal 70.

The disclosed concept employs a single centered main style of operating handle 4, while hiding the fact that it is a dual pole device, and providing a relatively more robust, main circuit breaker appearance.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

an enclosure having an opening;

a single operating handle disposed through the opening of said enclosure;

a first pole disposed in said enclosure, said first pole comprising:

first separable contacts, a first operating mechanism structured to open and close said first separable contacts, and a first operating member cooperating with said first operating mechanism to open and close said first separable contacts; and a second pole disposed in said enclosure parallel to said first pole, said second pole comprising:

second separable contacts, a second operating mechanism structured to open and close said second separable contacts, and a second operating member cooperating with said second operating mechanism to open and close said second separable contacts, wherein said single operating handle comprises a first projection within said enclosure cooperating with said first operating member to open and close said first separable contacts, and a second projection within said enclosure cooperating with said second operating member to open and close said second separable contacts, and wherein said single operating handle is centered between said first and second parallel poles;

wherein said first projection comprises a first tapered channel therein; wherein said first operating member comprises a first tapered member engaging said first projection at the first tapered channel; wherein said second projection comprises a second tapered channel therein; and wherein said second operating member comprises a second tapered member engaging said second projection at the second tapered channel.

2. The electrical switching apparatus of claim 1 wherein said enclosure comprises six sides; and wherein said opening is centrally located on one of said six sides.

3. The electrical switching apparatus of claim 1 wherein said enclosure comprises a plurality of sides; wherein one of said sides comprises a side portion and a raised portion extending beyond said side portion; and wherein said single operating handle further comprises a handle portion extending external to said enclosure, an arcuate portion coupled to said handle portion within said enclosure and being partially visible through the opening of said enclosure, and an internal portion entirely within said enclosure and being coupled to said first and second projections within said enclosure.

4. The electrical switching apparatus of claim 3 wherein the raised portion of said one of said sides clears the arcuate portion of said single operating handle; and wherein only said single operating handle is visible through the opening.

5. The electrical switching apparatus of claim 1 wherein each of said first and second poles further comprises a trip mechanism cooperating with a corresponding one of said first and second operating mechanisms to trip open said first and second separable contacts, respectively.

6. The electrical switching apparatus of claim 1 wherein said electrical switching apparatus is a two-pole circuit interrupter.

7. The electrical switching apparatus of claim 6 wherein said two-pole circuit interrupter is a main circuit breaker.

8. The electrical switching apparatus of claim 1 wherein said single operating handle has an on position with respect to said enclosure; and wherein each of said first and second operating members has an on position corresponding the on position of said single operating handle.

9. The electrical switching apparatus of claim 1 wherein said single operating handle has a tripped position with respect to said enclosure; and wherein each of said first and second operating members has a tripped position corresponding the tripped position of said single operating handle.

10. The electrical switching apparatus of claim 1 wherein said single operating handle has an off position with respect to said enclosure; and wherein each of said first and second operating members has an off position corresponding the off position of said single operating handle.

11. The electrical switching apparatus of claim 1 wherein said single operating handle has a reset position with respect to said enclosure; and wherein each of said first and second operating members has a reset position corresponding the reset position of said single operating handle.

12. The electrical switching apparatus of claim 1 wherein said second separable contacts are electrically independent of said first separable contacts.

* * * * *